United States Patent [19]

Bogart

[11] 4,187,964

[45] Feb. 12, 1980

[54] COMBINED CLOSURE CAP AND POUR-OUT FITMENT

[75] Inventor: Burton S. Bogart, Columbus, Ohio

[73] Assignee: Anchor Hocking Corporation, Lancaster, Ohio

[21] Appl. No.: 929,998

[22] Filed: Aug. 1, 1978

[51] Int. Cl.[2] ..... B65D 41/04; B65D 41/28

[52] U.S. Cl. ..... 222/546; 222/547; 222/563

[58] Field of Search ..... 222/546, 563, 547; 215/320, 355

[56] References Cited

U.S. PATENT DOCUMENTS

| | | | |
|---|---|---|---|
| 2,829,807 | 4/1958 | Kirschenbaum | 222/546 X |
| 3,342,379 | 9/1967 | Foley | 222/546 X |
| 3,980,211 | 9/1976 | Owens | 222/547 |

FOREIGN PATENT DOCUMENTS

| | | | |
|---|---|---|---|
| 710851 | 6/1954 | United Kingdom | 222/547 |

*Primary Examiner*—Allen N. Knowles

*Attorney, Agent, or Firm*—Holland, Armstrong, Wilkie & Previto

[57] ABSTRACT

This invention is a combined closure cap and pour-out fitment of the type used to seal glass or plastic or similar containers and particularly containers containing dispensible products such as salad dressings. The combination contains a pour-out fitment which is applied to the container with the closure and which remains on the container after the sealing closure is removed for limiting the flow of the dressing or other products. The dispensing fitment is a separately molded disc-like structure with a center aperture and is adapted for being snapped into the closure prior to the application of the closure to a container. The fitment and closure combination seal the container without any additional sealing liner.

14 Claims, 7 Drawing Figures

Fig. 1.
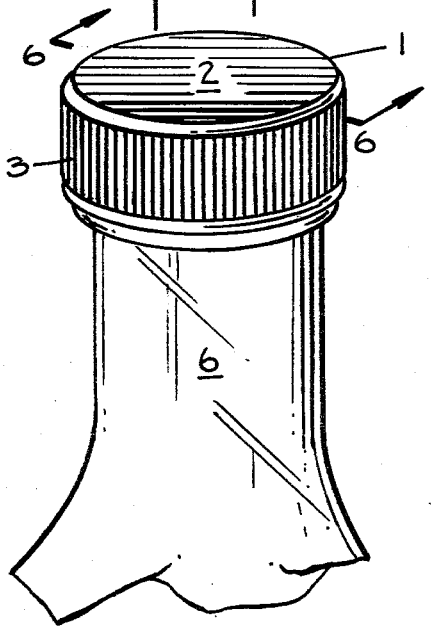
Fig. 3.
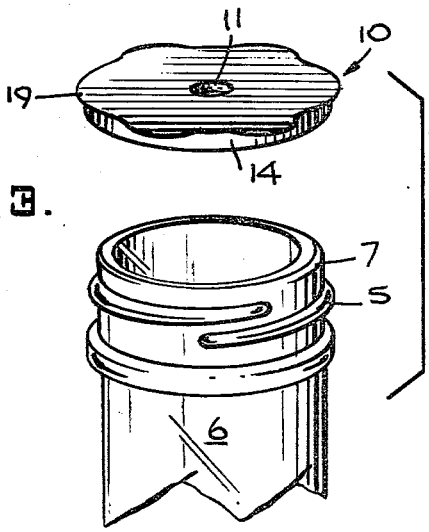
Fig. 4.
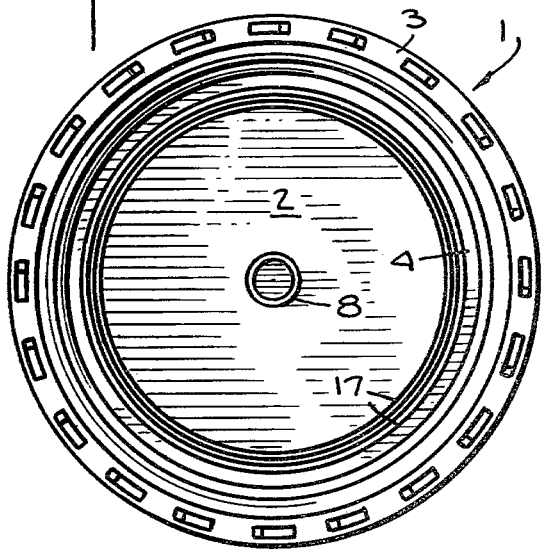
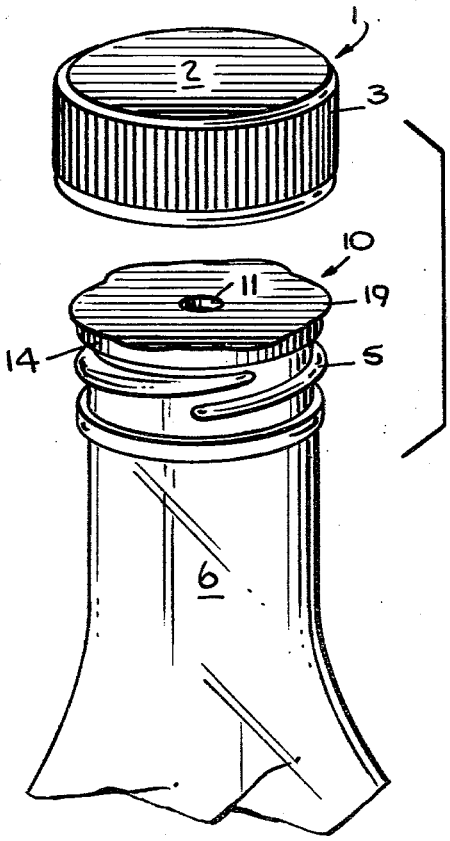
Fig. 2.
Fig. 5.
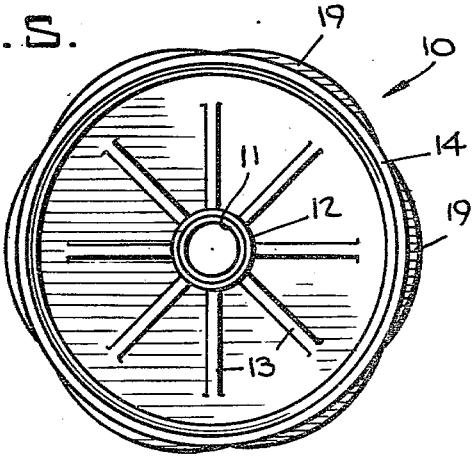

COMBINED CLOSURE CAP AND POUR-OUT FITMENT

BACKGROUND OF THE INVENTION

The present invention relates to container sealing and more particularly to an improved closure for a dispensing container such as a salad dressing or other product dispensing container. More particularly, the invention relates to an improved combined closure cap and pour-out fitment separately manufactured but pre-assembled for application to the container as a unit and without the use of an additional sealing liner.

The use of a pour-out fitment is well known in certain packages, for example, with salad oil or other salad dressing containers. These fitments are designed to snap over or otherwise attach themselves to the bottle tops and to remain on the bottle when the outer sealing closure is removed from the bottle. For this purpose, prior fitments have had grooves or tabs or other means for attachment to the bottle. The fitments have been applied during the container sealing operation by being applied to the container before the final sealing closure is applied. Prior fitments have included various forms of liners or seals for sealing the fitment edge to the container and for sealing the outer closure to the container.

The closure and fitment of the present invention are an improvement as they are designed for simple pre-assembly so that they may be applied to the container as a unit during the sealing operation. Additionally, a simplified design has been made in which the fitment, in cooperation with the closure cap, provides for a suitable sealing of the container without separate or additional sealing elements. The combined closure cap and fitment, therefore, not only provide an improved and simplified pour-out fitment but they also act as an improved linerless closure.

Accordingly, an object of the present invention is to provide an improved pour-out closure combination.

Another object of the present invention is to provide a simplified pouring-type closure which is applied to the container as a unit.

Another object of the present invention is to provide an improved pouring-type closure which is a linerless closure.

Another object of the present invention is to provide an improved and simplified pour-type closure which is more easily applied to the container during the initial sealing operation.

Another object of the present invention is to provide a simplified and less expensive pour-type closure.

Another object of the present invention is to provide an improved plastic pour-type dressing closure.

Other and further objects of the present invention will be apparent upon an understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

A preferred embodiment of the invention has been chosen for purposes of illustration and description and is shown in the accompanying drawings, forming a part of the specification, wherein:

FIG. 1 is a perspective view illustrating the preferred closure cap combination sealing a container.

FIG. 2 is an exploded perspective view illustrating the sealing closure cap removed from the container.

FIG. 3 is an exploded perspective view illustrating the pour-out fitment removed from the container top.

FIG. 4 is a bottom plan view of the outer sealing closure.

FIG. 5 is a bottom plan view of the pour-out fitment.

DESCRIPTION OF THE PREFERRED EMBODIMENT

Figure 6:
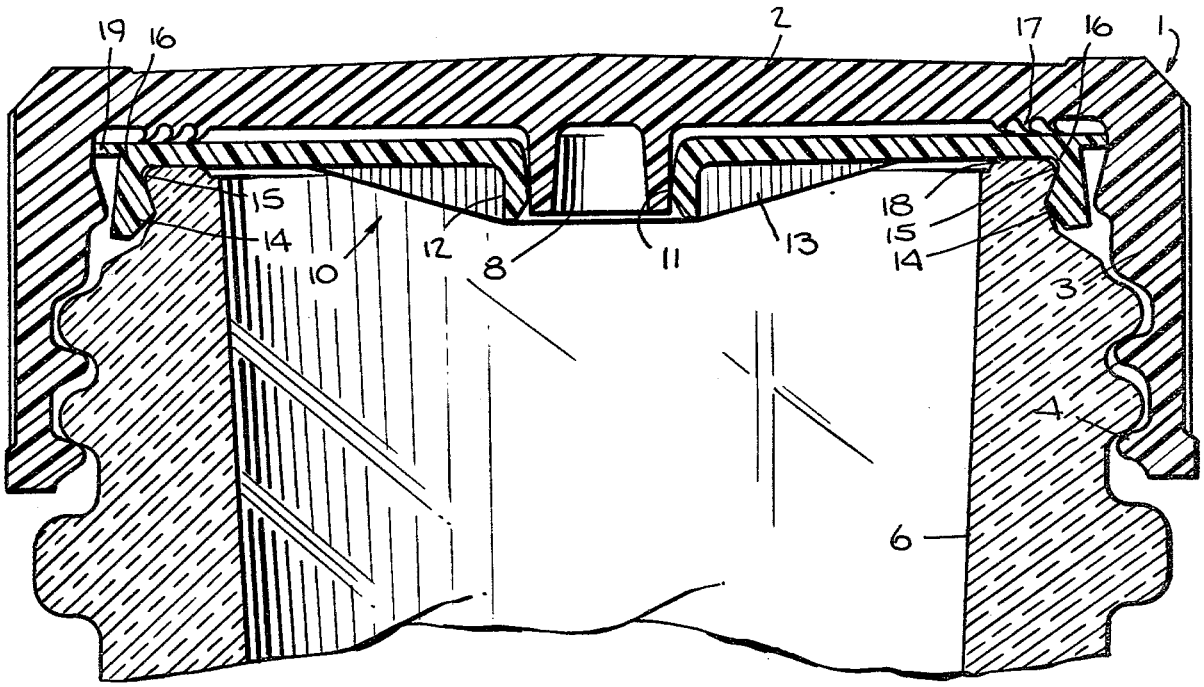
FIG. 6 is a sectional view of the sealed container taken along line 6—6 of FIG. 1.

The closure of this invention is used for sealing the well known dressing-type packages or similar packages where the user shakes or pours a limited quantity of the packaged dressing or other product from the container. In order to simplify the dispensing operation, the package such as a glass or plastic container is supplied with the pour-out fitment which is a disc-like plastic member designed for being snapped onto or otherwise attached to the bottle top. The fitment has an aperture of predetermined size arranged to limit the passage of the particular product being dispensed. The combination closure and pour-out fitment in accordance with the invention comprises a molded outer closure 1 having a cover 2 and a depending skirt 3 with container engaging threads 4 or other means being provided on the interior surface of the skirt 3. In the embodiment illustrated in the drawing, the container engaging means comprise continuous threads 4 adapted for engaging cooperating threads 5 at the container 6 mouth 7. The closure is molded of the conventional plastic materials used for such molded closures such as polypropylene.

At the center of the underside of the closure cover 2, a circular sealing plug 8 projects downwardly for frictionally engaging and for sealing the pour spout or aperture 11 in the pour-out fitment, 10.

The fitment 10 is also a molded plastic article of polyethylene and of a generally disc-like form with a central pour-out aperture 11. The pour-out aperture 11 preferably is formed with a downwardly projecting flange 12 and radially directed stiffening or support members 13 to provide a well defined spout-like aperture and one which may be resealed with the cooperating flange-like plug 8 on the closure cap 1. The outer edge of the fitment 10 has a downwardly depending skirt or flange 14 with a groove 15 in its inner surface. The groove 15 is provided for frictionally engaging a bead 16 on the container 6 rim as best illustrated in FIG. 6.

The outer edge of the fitment 10 top is provided with a plurality of radially projecting ears or lugs 19 which frictionally engage the inner surface of the closure cap skirt 3. The lugs 19 hold the fitment 10 and closure 1 together after assembly permitting the closure cap 1 and the fitment 10 to be handled as a unit. The assembly, for example, may be hoppered and fed through cap orienting applying and sealing means in the same manner as an ordinary one piece closure.

As already indicated, the plug 8 which is provided on the bottom of the closure cover 2 acts to seal the pour-out aperture 11 in the fitment 10 when the package is sealed. In addition, a plurality of flexible and generally trianguler sealing ribs 17 may be provided on the underside closure cap cover 2. These provide a secondary seal between the closure 1 and the fitment 10. In addition, the ribs 17 permit the closure 1 to be used without the fitment as a linerless closure.

Figure 7:
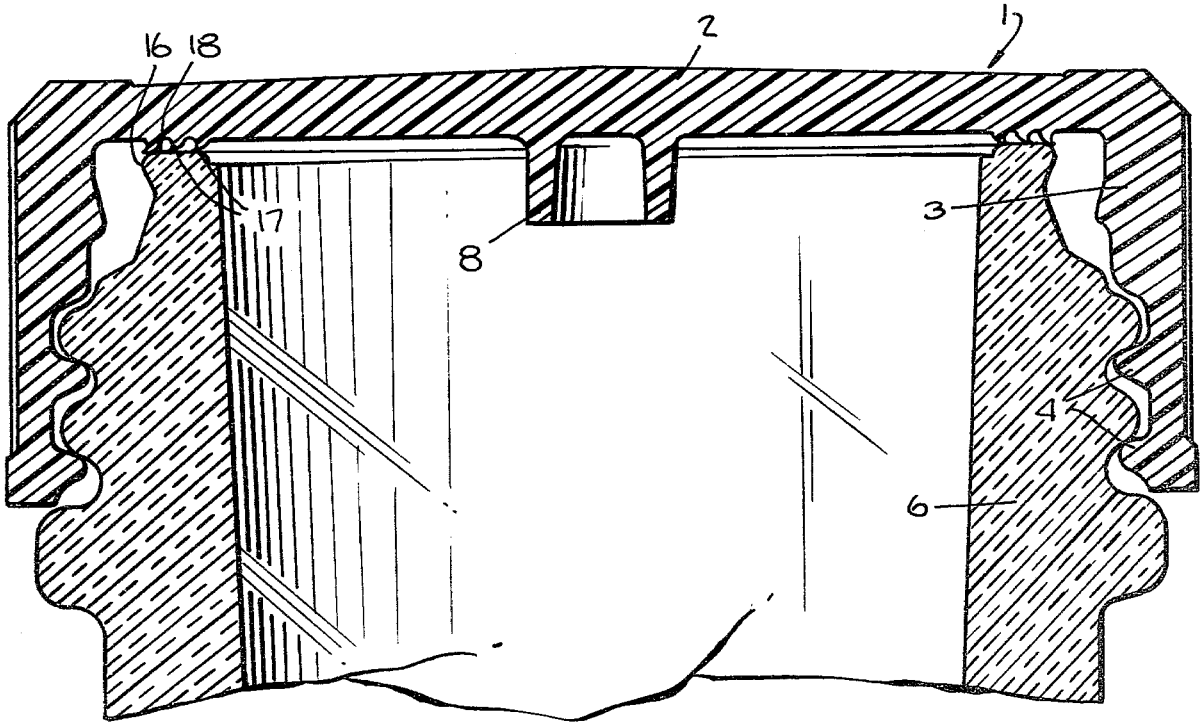
FIG. 7 is a vertical sectional view illustrating the outer closure cap used as a linerless closure without the pour-out fitment.

FIG. 7, for example, shows a closure 2 sealing a container 6. The three flexible ribs are illustrated in sealing engagement with a relatively flat upper surface 18 of the finish of the container 6.

It will be seen that an improved pour-out closure has been provided for use with dispensing containers. The closure assembly includes an outer closure cap and an inner pour-out fitment which are assembled as a unit prior to a package sealing. The assembled closure and fitment then may be handled in a routine way similar to that used for sealing ordinary one piece closures. They may be hoppered, selected, applied and sealed in the normal manner of a unitary closure. The improved pour-out closure also is a linerless closure so that it may be easily and inexpensively produced and applied.

As various changes may be made in the form, construction and arrangement of the parts herein without departing from the spirit and scope of the invention and without sacrificing any of its advantages, it is to be understood that all matter herein is to be interpreted as illustrative and not in a limiting sense.

Having thus described our invention, we claim:

1. In combination a closure cap and pour-out firment:

said closure cap including a cover and a depending skirt with container engaging means;

a projecting plug at the center of the underside of said closure cover;

a pour-out fitment having a disc-like membrane with closure cap engaging means at its edge frictionally engaging the inner surface of said closure skirt between the closure cover and the container engaging means;

a pour-out aperture at the center of said membrane for receiving said plug;

means at the outer edge of said membrane for frictionally engaging a container at its rim when the combination is applied to the container; and a plurality of sealing ribs near the outer edge of the underside of said closure cover for sealing engagement with the facing surface of said fitment membrane.

2. The combination as claimed in claim 1 in which said plug comprises a hollow cylindrical member.

3. The combination as claimed in claim 1 in which said container engaging means on said fitment comprises a radially inwardly directed bead for engaging a complimentary groove at the rim of the container.

4. The combination as claimed in claim 1 in which said container engaging means on said closure cap skirt comprises continuous threads.

5. The combination as claimed in claim 1 in which said closure is molded polypropylene.

6. The combination as claimed in claim 1 in which said fitment is molded plastic resin.

7. The combination as claimed in claim 1 in which said closure cap is molded of plastic resin.

8. The combination as claimed in claim 1 in which this fitment is polyethylene.

9. A pour-out fitment having a disc-like membrane with closure engaging means at its edge for frictionally engaging the inner surface of a closure skirt, a pour-out aperture in said membrane, and means at the outer edge of said membrane for engaging a container; and said closure engaging means comprising a plurality of spaced lugs.

10. The fitment as claimed in claim 9 in which said container engaging means comprises an inwardly directed bead for engaging a groove in a container rim.

11. The fitment as claimed in claim 9 in which said aperture is formed in the said membrane and a circular flanged portion projecting therefrom.

12. The fitment as claimed in claim 11 which further comprises support members for said flanged portion.

13. The fitment as claimed in claim 9 which is polyethelyene.

14. In combination a closure cap and pour-out fitment:

said closure cap including a cover and a depending skirt with container engaging means;

a projecting plug at the center of the underside of said closure cover;

a pour-out fitment having a disc-like membrane with closure engaging means at its edge frictionally engaging the inner surface of said closure skirt between the closure cover and the container engaging means;

a pour-out aperture at the center of said membrane for receiving said plug;

means at the outer edge of said membrane for frictionally engaging a container at its rim when the combination is applied to the container; and the closure engaging means at the edge of said fitment membrane comprising a plurality of radially projecting and circumferentially spaced lugs.

* * * * *